US011497111B2

(12) United States Patent
Varela Alonso

(10) Patent No.: US 11,497,111 B2
(45) Date of Patent: Nov. 8, 2022

(54) LOW-EROSION INTERNAL ION SOURCE FOR CYCLOTRONS

(71) Applicant: CENTRO DE INVESTIGACIONES ENERGETICAS, MEDIOAMBIENTALES Y TECNOLOGICAS (CIEMAT), Madrid (ES)

(72) Inventor: Rodrigo Varela Alonso, Madrid (ES)

(73) Assignee: CENTRO DE INVESTIGACIONES ENERGETICAS, MEDIOAMBIENTALES Y TECHNOLOGICAS (CIEMAT), Madrid (ES)

( * ) Notice: Subject to any disclaimer, the term of this patent is extended or adjusted under 35 U.S.C. 154(b) by 66 days.

(21) Appl. No.: 17/258,641

(22) PCT Filed: Jul. 1, 2019

(86) PCT No.: PCT/ES2019/070461

§ 371 (c)(1),
(2) Date: Jan. 7, 2021

(87) PCT Pub. No.: WO2020/012047

PCT Pub. Date: Jan. 16, 2020

(65) Prior Publication Data

US 2021/0274632 A1 Sep. 2, 2021

(30) Foreign Application Priority Data

Jul. 10, 2018 (ES) ..... ES201830684

(51) Int. Cl.

| | |
|---|---|
| ***H05H 7/18*** | (2006.01) |
| ***H05H 7/08*** | (2006.01) |
| ***H05H 13/00*** | (2006.01) |

(52) U.S. Cl.
CPC ..... *H05H 7/18* (2013.01); *H05H 7/08* (2013.01); *H05H 13/005* (2013.01); *H05H 2007/082* (2013.01)

(58) Field of Classification Search
None
See application file for complete search history.

(56) References Cited

U.S. PATENT DOCUMENTS 4,507,588 A * 3/1985 Asmussen ..... H01J 37/32256 315/111.41
4,585,668 A * 4/1986 Asmussen ..... H01J 37/32192 427/539

(Continued)

FOREIGN PATENT DOCUMENTS

DE 4413234 A1 10/1995
EP 1272015 A1 1/2003

OTHER PUBLICATIONS

International Search Report for Corresponding International Application No. PCT/ES2019/070461 (dated Sep. 18, 2019) with English Translation.

*Primary Examiner* — Srinivas Sathiraju
(74) *Attorney, Agent, or Firm* — Lucas & Mercanti, LLP

(57) ABSTRACT

A low-erosion radio frequency ion source is disclosed having a hollow body with conductive interior walls that define a cylindrical cavity, with a gas supply inlet for plasma-forming gases and a power supply inlet for injecting radio frequency energy into the cavity; an expansion chamber connected to the cavity by means of a plasma outlet hole; an ion-extraction aperture in contact with the expansion chamber; coaxial conductor disposed in the cavity, parallel to the longitudinal axis thereof, one or both ends of the coaxial conductor being in contact with a circular interior wall of the body, forming a coaxial resonant cavity; the coaxial conductor having a conductive protuberance opposite the (Continued)

plasma outlet hole and which extends radially into the cavity. It substantially reduces the erosion of the conductive materials.

13 Claims, 19 Drawing Sheets

(56) References Cited

U.S. PATENT DOCUMENTS 4,611,148 A * 9/1986 Kato ..... H01J 61/545 313/493
4,630,566 A * 12/1986 Asmussen ..... H01J 37/32678 204/298.37
4,631,438 A * 12/1986 Jacquot ..... H01J 27/18 315/111.81
4,642,523 A * 2/1987 Nakanishi ..... F03H 1/0037 315/111.81
4,673,456 A * 6/1987 Spencer ..... G03F 7/427 438/711
4,691,662 A * 9/1987 Roppel ..... H01J 37/32678 118/723 MR
4,710,283 A * 12/1987 Singh ..... H01J 27/14 315/111.81
4,727,293 A * 2/1988 Asmussen ..... H01J 37/32678 118/723 MR
4,777,336 A * 10/1988 Asmussen ..... H05B 6/702 219/696
4,857,809 A * 8/1989 Torii ..... H01J 27/18 315/111.41
4,859,909 A * 8/1989 Gualandris ..... H01J 27/16 315/39
4,898,557 A * 2/1990 Engemann ..... H01J 27/024 445/24
4,902,870 A * 2/1990 Frind ..... H05H 1/36 219/121.48
4,906,900 A * 3/1990 Asmussen ..... H05H 1/46 315/111.41
4,943,345 A * 7/1990 Asmussen ..... C23C 16/505 118/728
4,987,346 A * 1/1991 Katzschner ..... H01J 37/08 315/111.41
4,992,665 A 2/1991 Mohl
5,008,506 A * 4/1991 Asmussen ..... H05B 6/705 219/696
5,069,928 A * 12/1991 Echizen ..... H01J 37/32357 118/723 MR
5,081,398 A * 1/1992 Asmussen ..... H05H 1/30 315/111.41
5,111,111 A * 5/1992 Stevens ..... H01J 37/32238 118/723 MR
5,142,198 A * 8/1992 Smith ..... H01J 37/32247 315/111.21
5,146,742 A * 9/1992 Iida ..... F03H 1/0043 60/202
5,182,496 A * 1/1993 Manheimer ..... H01Q 1/366 315/111.41
5,191,182 A * 3/1993 Gelorme ..... G01N 22/00 219/709
5,198,718 A * 3/1993 Davis ..... H01J 37/08 313/363.1
5,204,144 A * 4/1993 Cann ..... C23C 16/4584 427/571
5,213,248 A * 5/1993 Horton ..... B23K 20/025 228/44.7
5,216,330 A * 6/1993 Ahonen ..... H01J 27/16 315/111.21
5,225,740 A * 7/1993 Ohkawa ..... H05H 1/46 315/111.41
5,317,081 A * 5/1994 Gelorme ..... G01N 22/00 528/229
5,340,914 A * 8/1994 Cuomo ..... H05B 6/705 528/229
6,253,703 B1 * 7/2001 Echizen ..... H01J 37/32357 118/723 ME
6,388,225 B1 5/2002 Blum et al.
6,495,842 B1 12/2002 Huttel et al.
7,371,992 B2 * 5/2008 Carr ..... H01L 21/67028 257/E21.226
7,378,673 B2 * 5/2008 Bykanov ..... H05G 2/006 250/493.1
7,439,530 B2 * 10/2008 Ershov ..... H05G 2/008 372/18
7,465,362 B2 * 12/2008 Kumar ..... C23C 8/36 148/222
7,482,609 B2 * 1/2009 Ershov ..... H05G 2/005 372/18
7,494,904 B2 * 2/2009 Kumar ..... H01J 37/32412 438/513
7,497,922 B2 * 3/2009 Kumar ..... B01J 19/126 156/345.48
7,498,066 B2 * 3/2009 Kumar ..... B05B 7/22 427/575
7,510,664 B2 * 3/2009 Carr ..... H01L 21/67092 216/68
7,521,694 B2 * 4/2009 Cha ..... H01J 37/3171 250/492.21
8,748,785 B2 * 6/2014 Jordan ..... H05H 1/30 219/121.36
2021/0274632 A1 * 9/2021 Varela Alonso ..... H05H 7/08

* cited by examiner

LOW-EROSION INTERNAL ION SOURCE FOR CYCLOTRONS

CROSS REFERENCE TO RELATED APPLICATION

This Application is a 371 of PCT/ES2019/070461 filed on Jul. 1, 2019 which, in turn, claimed the priority of Spanish Patent Application No. P201830684 filed on Jul. 10, 2018, both applications are incorporated herein by reference.

FIELD OF THE INVENTION

The present invention falls within the field of ion sources for particle accelerators.

BACKGROUND OF THE INVENTION

An ion source is the component of particle accelerators where the gas is ionised, transforming into plasma, and from which the charged particles are then extracted to be accelerated. Ion sources are mainly used as internal sources in cyclotrons to produce lightweight positive ions and negative hydrogen. These types of machines have been traditionally used in the world of research as multipurpose beam machines for use in multiple fields. They have recently been used for radioisotope synthesis in radiopharmaceutical applications, as well as in proton/hadron therapy machines for the treatment of tumours.

Ion sources have traditionally been very present in the world of research in different fields, including their use in particle accelerators, and in the study of materials or the structure of matter. To generate ions, one starts with the material to be ionised (generally a gas) and electrons are removed or added to the atoms by means of one or more of the following processes: electron impact (direct ionisation and/or charge exchange), photoionisation and surface ionisation.

In its simplest scheme, an ion source is made up of a main chamber where the process takes place, material to ionise (introduced previously or continuously), an energy source for ionisation and an extraction system. According to the process followed, a general classification of the different types of ion sources can be made:

- Electron bombardment: they use accelerated electrons, typically generated in a cathode at a certain temperature, which impact the material and ionise the atoms and/or molecules thereof.
- DC/pulsed plasma discharge: they are similar to the previous sources in that they use a beam of electrons generated by a cathode, but in this case the pressures at which they operate are higher. For this reason, a plasma is generated which the fast electrons are responsible for maintaining by depositing energy in the form of collisions. This category includes Plasmatron, Duoplasmatron, Magnetron and Penning sources. They generally use magnetic fields to confine the paths of fast electrons and increase ionisation. The drawback of these sources is erosion on the cathode due to the high potential difference of the cathode, necessary for accelerating the electrons, which causes the ions to be accelerated in the opposite direction and impact against the cathode, removing material (sputtering) and limiting the life of said cathode.
- Radio-frequency discharge: they are an evolution of DC sources because they use an alternating electric field to accelerate the electrons instead of a continuous one. There are two types of these sources depending on how the plasma and the electric field are generated: capacitively coupled plasma (CCP) discharges and inductively coupled plasma (ICP) discharges. At low frequencies they continue to produce sputtering on the "cathodes" due to a high potential between the plasma and the metal medium; however, at high frequencies this potential decreases below a certain threshold and sputtering is practically non-existent, significantly increasing the life of said "cathodes".
- Electron Cyclotron Resonance (ECR/ECRIS): a particular design of radio-frequency discharge, since it is based on exciting the cyclotron resonance of electrons located in a magnetic field with a wave with suitable circular polarisation, which causes highly efficient absorption of the electromagnetic field energy in resonance areas which results in high ionisation.
- Laser: the method used in laser ion sources is photoionisation by means of several high-power lasers, the wavelength of which is tuned to different electronic transitions, achieving successive excitation of the electrons of the atom to be ionised.
- Surface ionisation: the method for producing ions involves heating a high work function material and injecting the material to be ionised.
- Charge exchange: this type of source uses a metal vapour with a high electron transfer rate through which it passes ions of the desired atom so that it becomes negatively charged.

In the case of internal ion sources for cyclotrons, the preferred application field for the present invention, due to the internal configuration of cyclotrons, with very little space available for internally coupling the ion sources and a very high magnetic field in the vertical direction which traps the paths of the electrons and does not let them move freely, the only internal sources that have been used to date for cyclotrons are Penning sources. Penning ion sources have two cathodes placed at the vertical ends and a hollow tube parallel to the magnetic field that surrounds them. Said cathodes can be externally heated or remain initially cool and then heated with ion bombardment from the discharge. Due to the symmetrical configuration of the cathodes and the magnetic field, the electrons are emitted and accelerated, moving in helical paths that increase ionisation, and when reaching the opposite end they are reflected due to the electric field. The collisions of fast electrons with the injected gas results in the creation of a plasma from which both positive ions and negative ions can be extracted. Penning ion sources have the drawback of the sputtering of cathodes which, despite being commonly made of materials with high resistance and high electron emission (such as tantalum), are subjected to excessive wear that makes frequent replacement necessary.

Penning ion sources are very simple and compact, using DC discharge. The use of an external source adds greater complexity to the system although it allows other methods to be used to generate the plasma, such that manufacturers do not usually include them in their commercial cyclotrons. The problem with all sources that use DC discharges is that this type of discharge erodes the cathodes while the plasma is active, meaning that they must be changed periodically and in these machines that are used for medical applications, it is generally desirable to have it running for as long as possible without interruptions. Furthermore, in the case of producing $H^-$, the high-energy electrons from the DC discharge are the particles that contribute the most to the destruction of $H^-$, so that the drawn current is reduced.

Therefore, it is necessary to have an internal ion source for cyclotrons that solves these drawbacks.

DESCRIPTION OF THE INVENTION

The present invention relates to a low-erosion radio frequency ion source, especially useful for use as an internal ion source for cyclotrons.

The ion source comprises:

- A hollow body whose interior walls define a cylindrical cavity. The body has a gas supply inlet through which a plasma-forming gas is introduced into the cavity. The body has a power supply inlet through which radio frequency energy is injected into the cavity. The interior walls of the body are electrically conductive (preferably the entire body is conductive).
- An expansion chamber connected to the cavity through a plasma outlet hole made in the body.
- An ion-extraction aperture in contact with the expansion chamber.
- A coaxial conductor disposed in the cavity of the body, arranged parallel to the longitudinal axis of the cavity. At least one of the ends of the coaxial conductor is in contact with at least one circular interior wall of the body, forming a coaxial resonant cavity. The coaxial conductor has a conductive protuberance that extends radially into the cavity. The conductive protuberance is opposite the plasma outlet hole.

In one embodiment, the ion source comprises a movable part partially introduced radially into the cavity through an opening made in the body to finely adjust the frequency of the resonant cavity. The moving part is preferably made of conductive material or dielectric material.

The radio-frequency energy supply is provided through a capacitive coupling or inductive coupling. Capacitive coupling is performed by means of a coaxial waveguide whose inner conductor is partially introduced into the cavity through the power supply input. Inductive coupling is performed by means of a loop that short-circuits an interior wall of the body with an inner conductor of a coaxial waveguide introduced through the power supply input.

In one embodiment, a first end of the coaxial conductor is in contact with a circular interior wall of the body, the second end of the coaxial conductor being free. In this embodiment, the conductive protuberance is preferably disposed at the second end of the coaxial conductor. The expansion chamber is preferably cylindrical and is arranged so that the longitudinal axis thereof is perpendicular to the longitudinal axis of the cavity. Alternatively, the expansion chamber can be arranged so that the longitudinal axis thereof is parallel to the longitudinal axis of the cavity.

In another embodiment, the two ends of the coaxial conductor are respectively in contact with the two circular interior walls of the body. In this embodiment, the conductive protuberance is preferably disposed in the central portion of the coaxial conductor.

The ion source can have a double cavity, comprising a second body and a second conductor that form a second coaxial resonant cavity. The cavities of both bodies are connected to each other through a common expansion chamber.

The ion source of the present invention enables solving the drawbacks of the Penning internal ion sources used in cyclotrons, in which the plasma is generated causing erosion on the conductive materials. Erosion occurs because the plasma is positively charged, so the electrons are attracted to the plasma, while the positive ions are rejected and accelerated by the potential difference between the plasma and the wall. Thus, if the energy of the ions at the time of collision with the wall is high enough (>>1 eV), atoms are removed from the material when the ion collides with the conductive material. The number of atoms removed depends on the conductive material.

In the proposed ion source, the plasma is generated without producing erosion on the conductive materials (i.e., the electrodes) used in the ion source, such that the maintenance and interruptions produced when the source is operating are much less than in the case of a Penning source. Thus, in an embodiment of the present invention where the radio frequency energy supply is used by means of capacitive discharge, working at a sufficiently high frequency (for example, 2.45 GHz), no erosion occurs on the source materials. Plasma discharge can operate in two different modes: the alpha mode, where the discharge is maintained thanks to the secondary electrons emitted by the cathode (or the portion that functioned as the cathode at that time), and the gamma mode, where the mechanism for heating the plasma is collisionless heating. The alpha mode occurs in DC discharges and in RF at low frequencies, and the transition to the gamma mode occurs starting at a certain frequency that depends on the characteristics of the plasma.

The formation of a resonator or coaxial resonant chamber makes it possible to increase the electric field and facilitate ignition, so that the ion source of the present invention further achieves much lower energy consumption.

In the ion source of the present invention, it is also not necessary to have hot cathodes at temperatures of the order of 2000 K; therefore, instead of using conductive materials with high resistance and high electron emission, such as tantalum, other less expensive materials such as copper can be used. Due to the collision of the ions with the cathodes, the kinetic energy thereof is converted into thermal energy which increases the temperature of the cathodes, which emit electrons by thermionic effect, which are necessary to maintain the DC discharge in Penning sources. As in the present invention, collisions with cathodes are much less energetic, the heating of the cathodes is much lower, and less thermally restrictive conductive materials can be used (i.e., with lower melting temperature and higher conductivity), such as copper.

Furthermore, in the case of producing H−, since the present ion source does not generate high-energy electrons in the plasma, the drawn current is significantly increased. The cross section for producing H− is the highest at low energy (1-10 eV); at higher energies the cross section for production decreases significantly, while the cross section for producing the destruction of H− increases notably, as explained in detail in H. Tawara, "Cross Sections and Related Data for Electron Collisions with Hydrogen Molecules and Molecular Ions".

BRIEF DESCRIPTION OF THE DRAWINGS

What follows is a very brief description of a series of drawings that aid in better understanding the invention, and which are expressly related to an embodiment of said invention that is presented by way of a non-limiting example of the same.

DETAILED DESCRIPTION OF THE INVENTION

The present invention relates to an ion source designed mainly for use as an internal source in cyclotrons.

Figure 1:
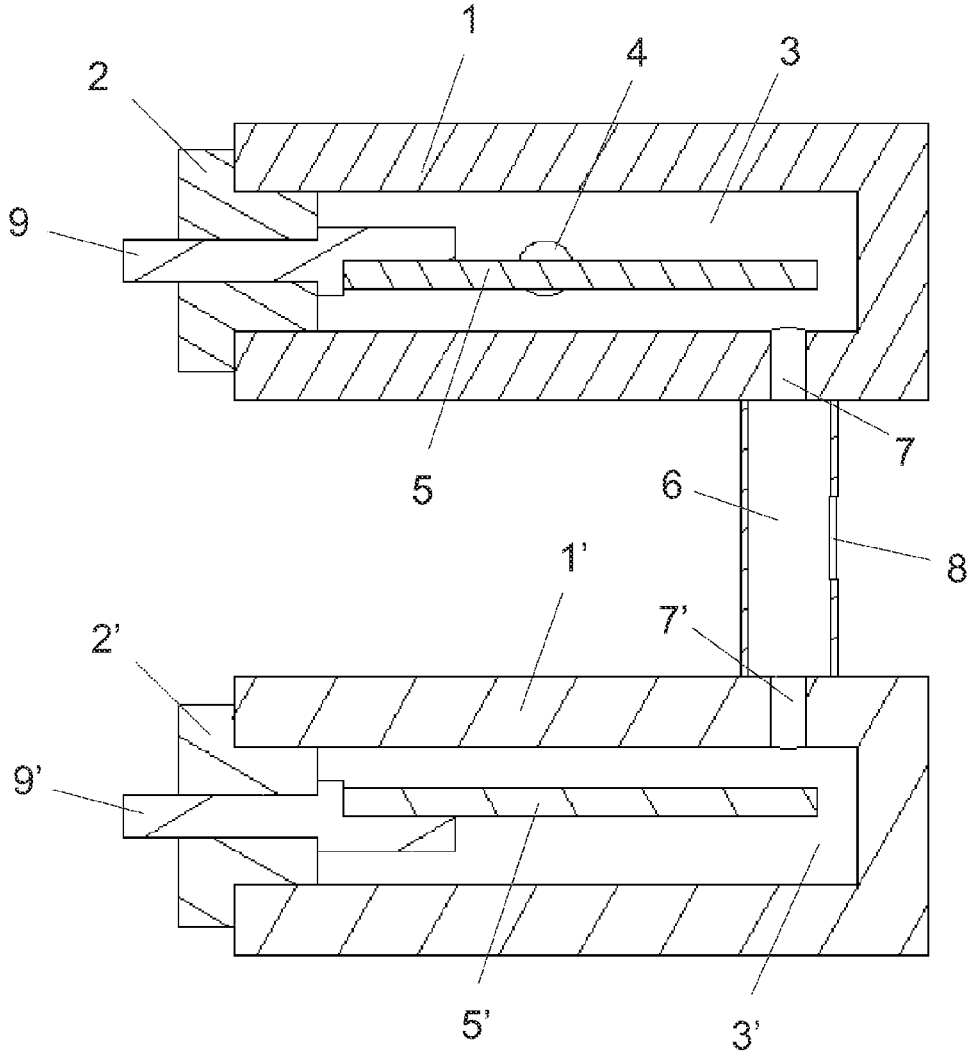
FIG. 1 shows, according to the state of the art, a front view of a longitudinal cross section of a double-cavity Penning ion source.
Figure 2:
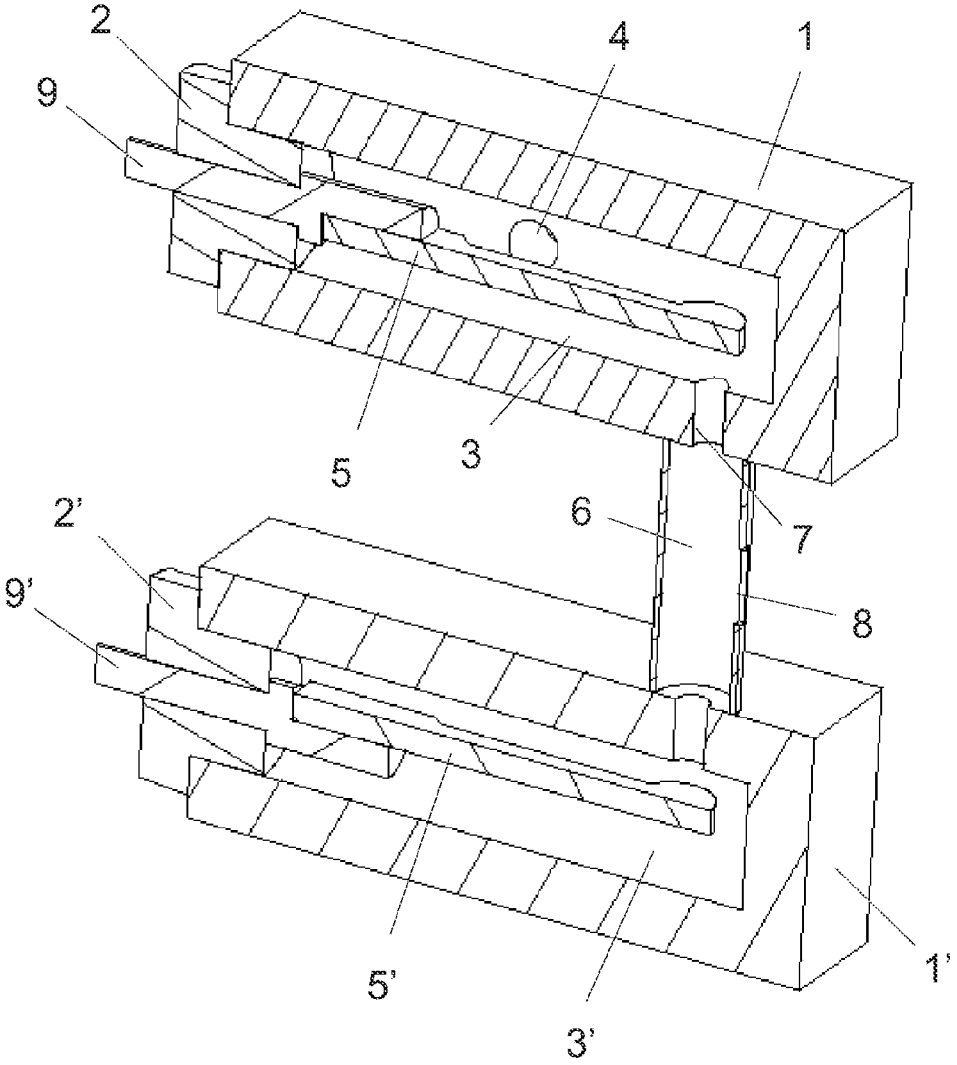
FIG. 2 shows, according to the state of the art, a perspective view of a longitudinal cross section of a double-cavity Penning ion source.

Currently, Penning ion sources are used as an internal source for cyclotrons, such as for example the one represented in FIG. 1 (longitudinal cross-sectional front view) and in FIG. 2 (longitudinal cross-sectional perspective view), which corresponds to a double-cavity ion source.

The double-cavity Penning ion source comprises two hollow bodies, each one made up of two parts, a conductive part (1, 1') and an insulating part (2, 2'), which fit together so that the interior walls thereof delimit a cylindrical cavity (3, 3'). At least one of the conductive parts 1 has a gas supply inlet 4 through which a plasma-forming gas is introduced into the respective cavity 3 thereof. In each cavity (3, 3') there is a coaxial conductor (5, 5') disposed in the cavity (3, 3') of the body (1, 1'), arranged parallel to the longitudinal axis of the cylindrical cavity (3, 3').

Both cavities (3, 3') are interconnected by means of a common cylindrical expansion chamber (6) through respective holes (7, 7') made in the walls of the conductive parts (1, 1'). An ion-extraction aperture (8) disposed in the walls which delimit the expansion chamber (6), in the central portion thereof, makes it possible to extract ions from the plasma generated from the gas introduced into the cavities (3, 3').

A conductive element (9, 9') is introduced into each cavity (3, 3'), penetrating through the insulating part (2, 2'), and in electrical contact with the coaxial conductor (5, 5') of the cavity. The conductive element (9, 9') is excited with DC voltages of around 3000 V. To start the discharge, it is necessary to open the gas flow and apply a potential difference of several thousand volts between anode and cathode (i.e., the conductive part 1/1' and the coaxial conductor 5/5'). After igniting the plasma, the power supply stabilises it by maintaining a potential difference between 500-1000V with a current of several hundred milliamps. The discharge that is established is of the DC type, requiring the emission of secondary electrons from the conductive material (such that they must be at a high temperature and be a material with high electron emissivity) and the ions that are expelled from the plasma are accelerated at high energy, causing erosion of the cathodes.

Figure 3:
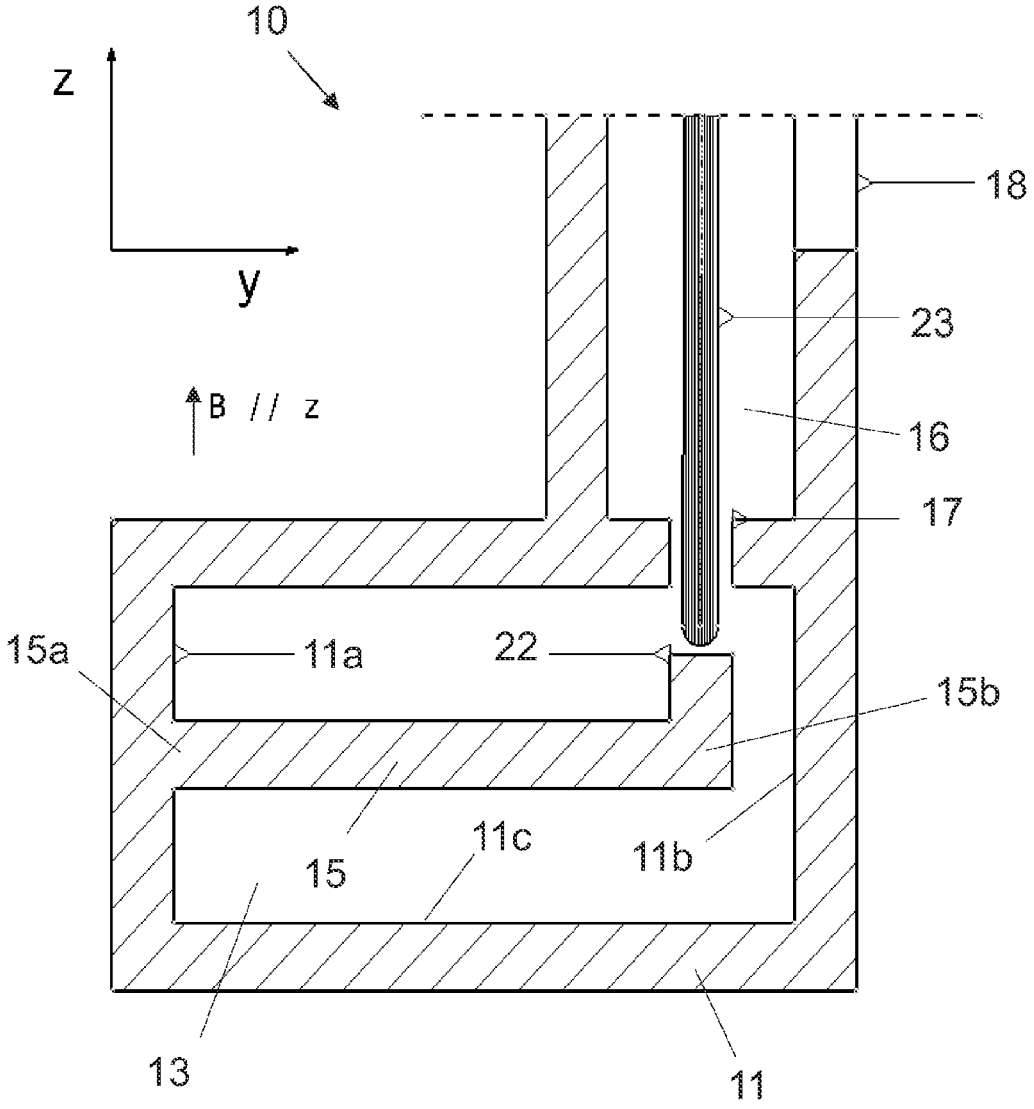
FIGS. 3, 4, 5 and 6 show different cross-sectional views of an ion source according to a possible embodiment of the present invention.

FIG. 3 shows a vertical cross section of an embodiment of the device object of the present invention, ion source 10, according to a cut plane perpendicular to the X-axis, wherein the external magnetic field B (normally generated by an electromagnet or a permanent magnet when the ion source is installed and running) is aligned with the vertical Z-axis of the reference system.

Figure 4:
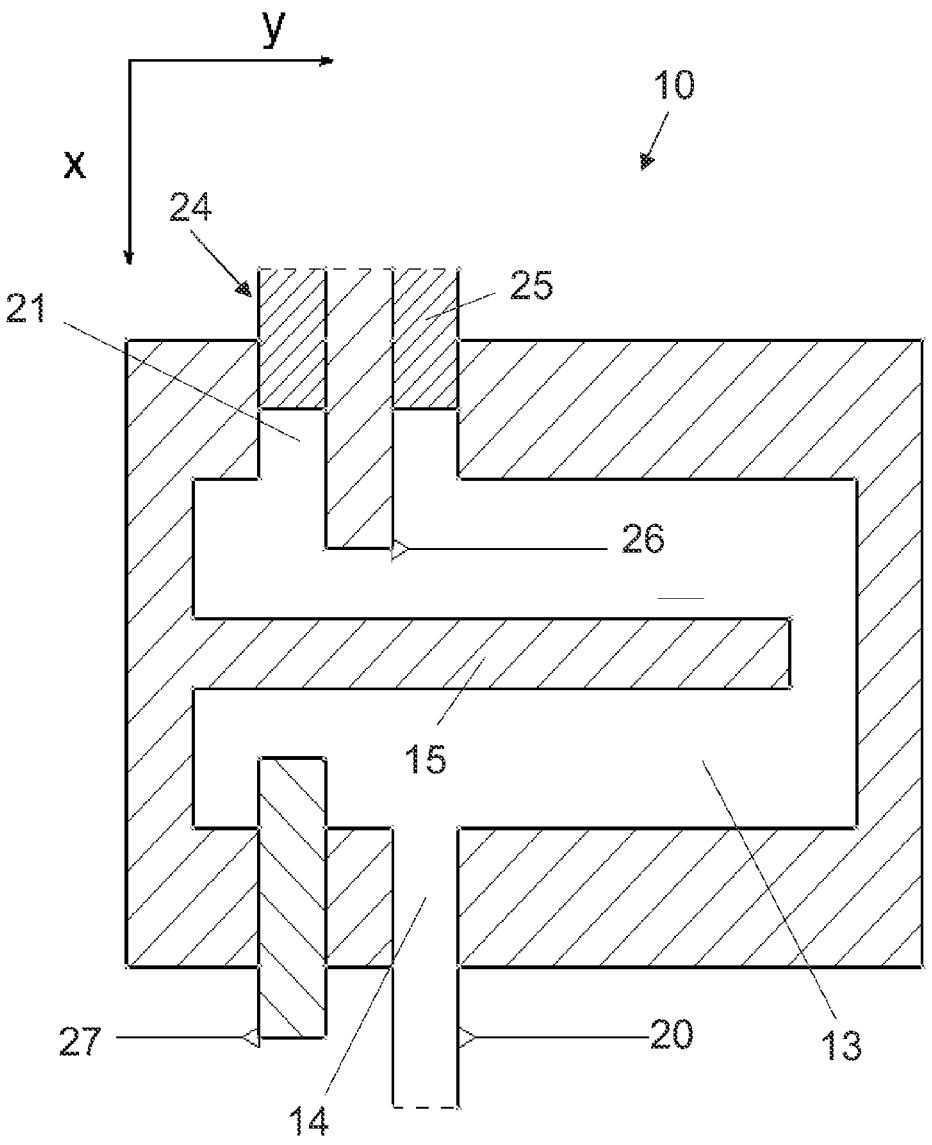

The operation of the ion source 10 is based on a coaxial resonant cavity. FIG. 4 shows a cross section of the ion source 10 according to the XY horizontal plane passing through the axis of the resonant cavity. The interior walls (11*a*, 11*b*, 11*c*) of a hollow body 11 are electrically conductive and define a cylindrical cavity 13. In one embodiment, the entire body 11 is conductive, preferably made of copper.

The body 11 has three interior walls: a first interior wall 11*a*, of circular geometry, a second interior wall 11*b*, also circular and opposite the first interior wall 11*a*, and a third interior wall 11*c*, of cylindrical geometry, which connects both circular interior walls (11*a*, 11*b*).

A coaxial conductor 15 is disposed in the cavity 13 of the body 11, arranged parallel to the longitudinal axis of the cylindrical cavity 13. At least one of the ends (15*a*, 15*b*) of the coaxial conductor 15 is in contact with one of the circular interior walls (11*a*, 11*b*) of the body 11, forming a coaxial resonant cavity. In this way, the coaxial conductor 15 can short-circuit both interior walls (11*a*, 11*b*) to obtain a $\lambda/2$ coaxial resonant cavity, obtaining the maximum electric field in the centre, or it short-circuits a single interior wall to obtain a $\lambda/4$ coaxial resonant cavity (with the maximum electric field at the opposite end of the conductor). In the example of FIGS. 3 and 4, only one of the ends of the coaxial conductor 15, specifically the first end 15*a*, short-circuits one of the circular interior walls of the body 11 (in particular, the first interior wall 11*a*), the body 11 and the coaxial conductor 15 thus forming a $\lambda/4$ coaxial resonant cavity, with the maximum electric field at the second end 15*b* of the coaxial conductor 15.

The body 11 has a gas supply port or inlet 14 (i.e., a hole or opening made in one of the walls thereof) through which a plasma-forming gas is introduced into the cavity 13. FIG. 4 shows a tube 20, hermetically coupled to the gas supply inlet 14, through which the gas is introduced into the cavity 13. These types of ion sources generally work with Hydrogen, and to a lesser extent Deuterium and Helium, depending on the ion to be extracted.

The body 11 also has a power supply inlet 21 through which radio frequency energy is injected into the cavity 13.

An expansion chamber 16 is connected to the cavity 13 through a plasma outlet hole 17 made in one of the walls of the body 11. An ion-extraction aperture 18 is disposed in one of the walls of the expansion chamber 16. The ion source 10 is introduced under vacuum into the chamber of a cyclotron, and the gas that is injected is partially transformed into plasma and the rest escapes through the ion-extraction aperture 18.

The coaxial conductor 15 has a conductive protuberance 22 that extends radially into the cavity 13 with respect to the axis of the cylindrical cavity (i.e., perpendicular to said axis), said conductive protuberance 22 being opposite the plasma outlet hole 17 of the body 11 that connects the cavity 13 to the expansion chamber 16 (i.e., the conductive protuberance 22 is opposite the expansion chamber 16). The conductive protuberance 22 does not come into contact with the interior wall of the body 11, although it remains very close, usually less than 5 millimetres; this separation distance will largely depend on the dimensions of the resonant cavity. The ignition voltage, injected power in the case of RF, will depend in turn on this separation distance and the density of the injected gas.

Depending on where the plasma is to be generated, the body 11 is short-circuited by the internal coaxial conductor 15 at one end 15*a* or at both ends (15*a*, 15*b*). The coaxial conductor 15 is an inner conductor that functions like an electrode opposite the outer conductor, the interior walls of the body 11, in such a way that when power is injected, the cavity 13 enters into resonance and the electric field that is established in the gap between the two conductors (11, 15) changes sign.

In the example of FIGS. 3 and 4, a portion of the free end of the coaxial conductor 15, second end 15*b*, is modified by means of a conductive protuberance or protrusion 22 directed towards the expansion chamber 16, in order to produce a concentration and an increase of the electric field in the area where the plasma is to be produced (plasma production area). The plasma produced escapes from the cavity 13 through the plasma outlet hole 17 towards the expansion chamber 16, forming a plasma column 23 aligned with the magnetic field B, from which the ions are extracted using the ion-extraction aperture 18. The expansion chamber 16 is a cavity, also preferably of cylindrical geometry, which performs the function of an expansion chamber for the plasma column 23. In the ion sources applied to cyclotrons, the expansion chamber 16 is a cylindrical cavity with a small radius so that after extracting the particles through the ion-extraction aperture 18 and accelerating them in the first turn, they do not collide with the source and are lost. The expansion chamber 16 also acts as a mechanical support, keeping the two symmetrical portions of the ion source separate, when they are a double-cavity ion source (as shown in FIGS. 1 and 2).

As shown in the embodiment of FIG. 4, a coaxial waveguide 24 which transports radio frequency/microwave energy is coupled through the power supply access, port or inlet 21, the coupling possibly being of the electrical (capacitive) or magnetic (inductive) type. FIG. 4 shows a typical capacitive coupling, wherein the dielectric 25 that surrounds the inner conductor 26 of the coaxial waveguide 24 enables the hermetic sealing of the power supply inlet 21 (so that portion of the injected gas does not escapes through said inlet), and wherein the inner conductor 26 of the coaxial waveguide 24 protrudes from the dielectric 25, partially entering into the cavity 13. Unlike this capacitive coupling, a typical inductive coupling uses a loop that short-circuits the interior of the coaxial waveguide with the resonant cavity.

The frequency of the resonant cavity can be adjusted by means of an insert or moving part 27 that is partially introduced into the cavity 13. The moving part 27 can be displaced radially at the moment of the initial configuration of the ion source 10 (i.e., perpendicular to the axis of the cylindrical cavity 13), thus allowing the resonance frequency to be finely adjusted based on the volume of the movable part 27 that is introduced into the cavity 13. The moving part 27 is an optional element, not strictly necessary for the operation of the ion source, although it improves the operation by making it easier to adjust the resonance frequency. The moving part 27 can be made of conductive material (preferably copper) or of dielectric material (such as alumina), depending on the behaviour and the variation in frequency to be achieved.

Figure 5:
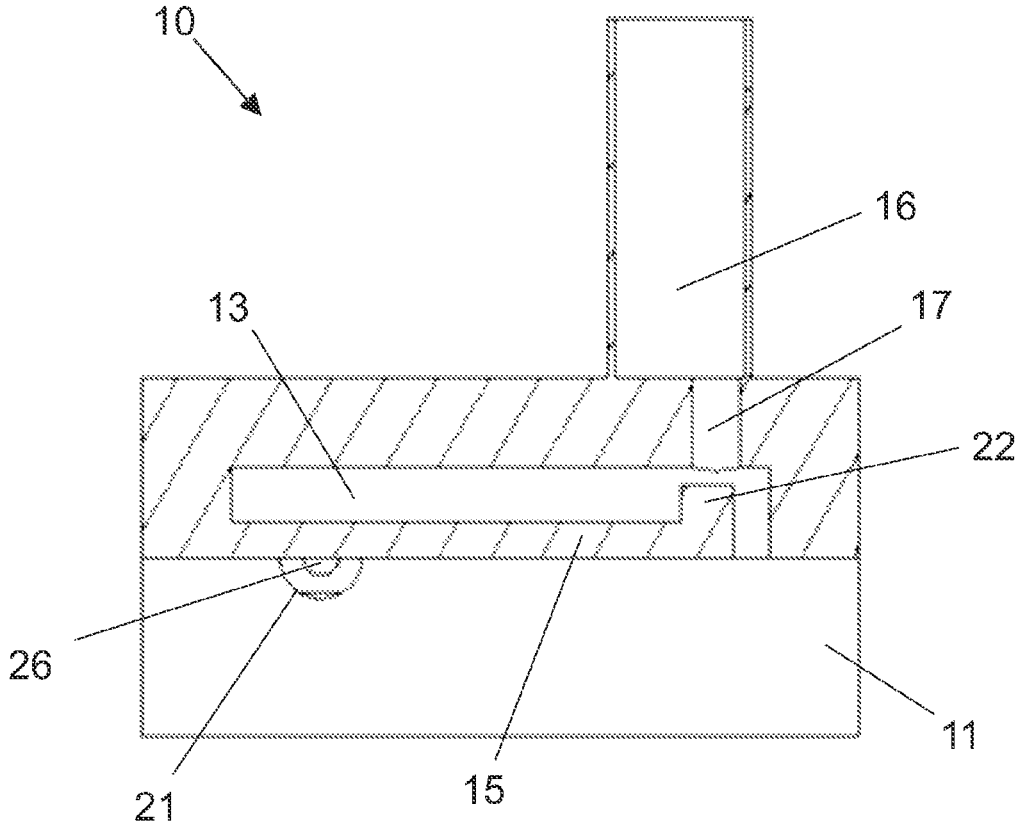
Figure 6:
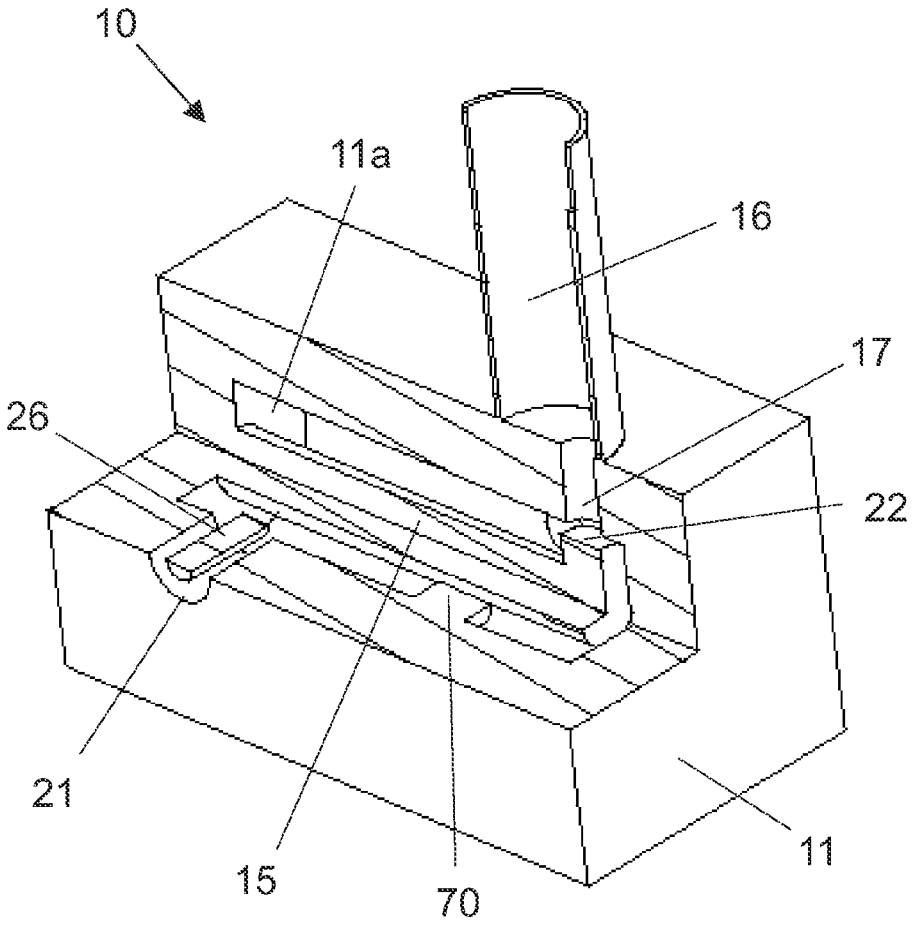

FIGS. 5 and 6 show two additional views of the ion source 10, according to one possible embodiment. FIG. 5 illustrates a front view of the ion source 10, wherein the portion above the axis of the cavity 13 is shown in mid-section. FIG. 6 shows a three-dimensional view of an ion source 10. The gas supply inlet 14 cannot be seen in FIG. 6 as it is disposed at the rear of the body 11 in this view. The projection 70 shown in FIG. 6 is an element with the same function as the movable part 27 of FIG. 4, an element by means of which the frequency of the resonant cavity is finely adjusted. In this case, the projection 70 is integrated into the body of the ion source, but it could be designed as a separate body.

Figure 7:
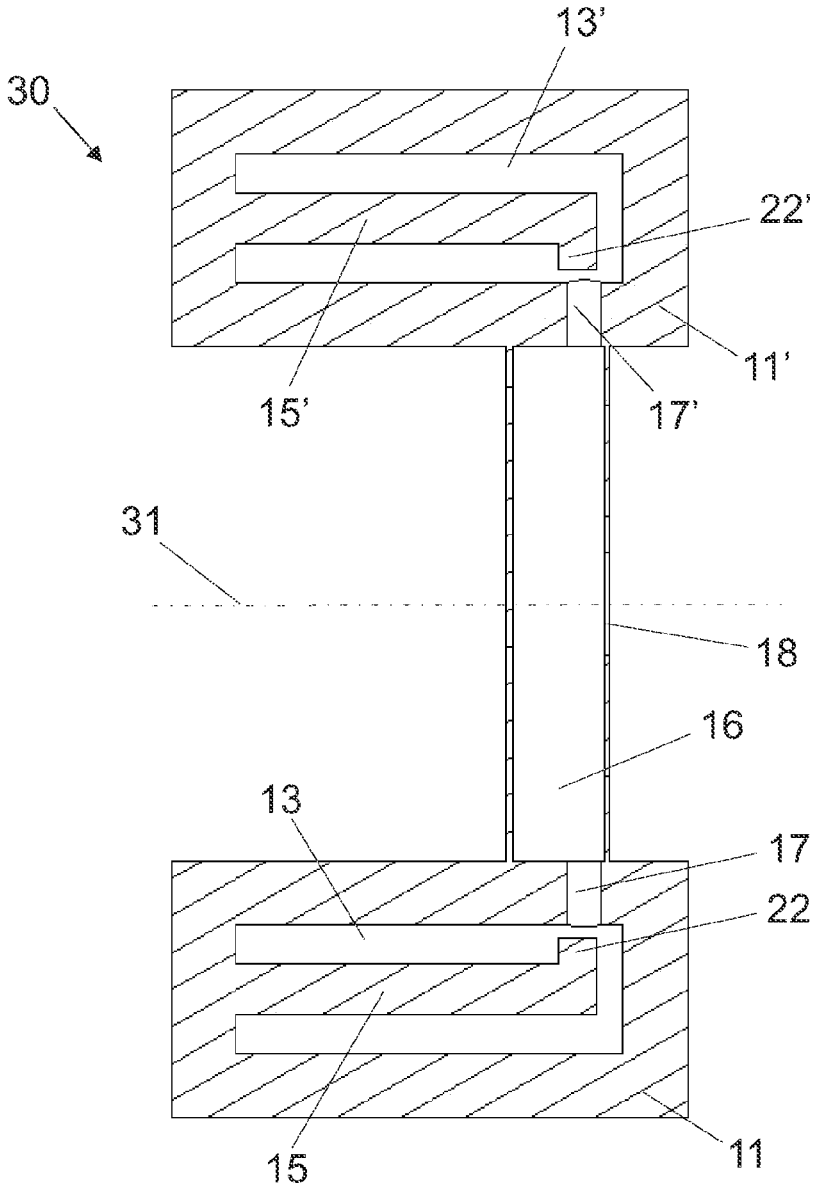
FIGS. 7 and 8 show cross-sectional views of a double-cavity ion source according to a possible embodiment of the present invention.
Figure 8:
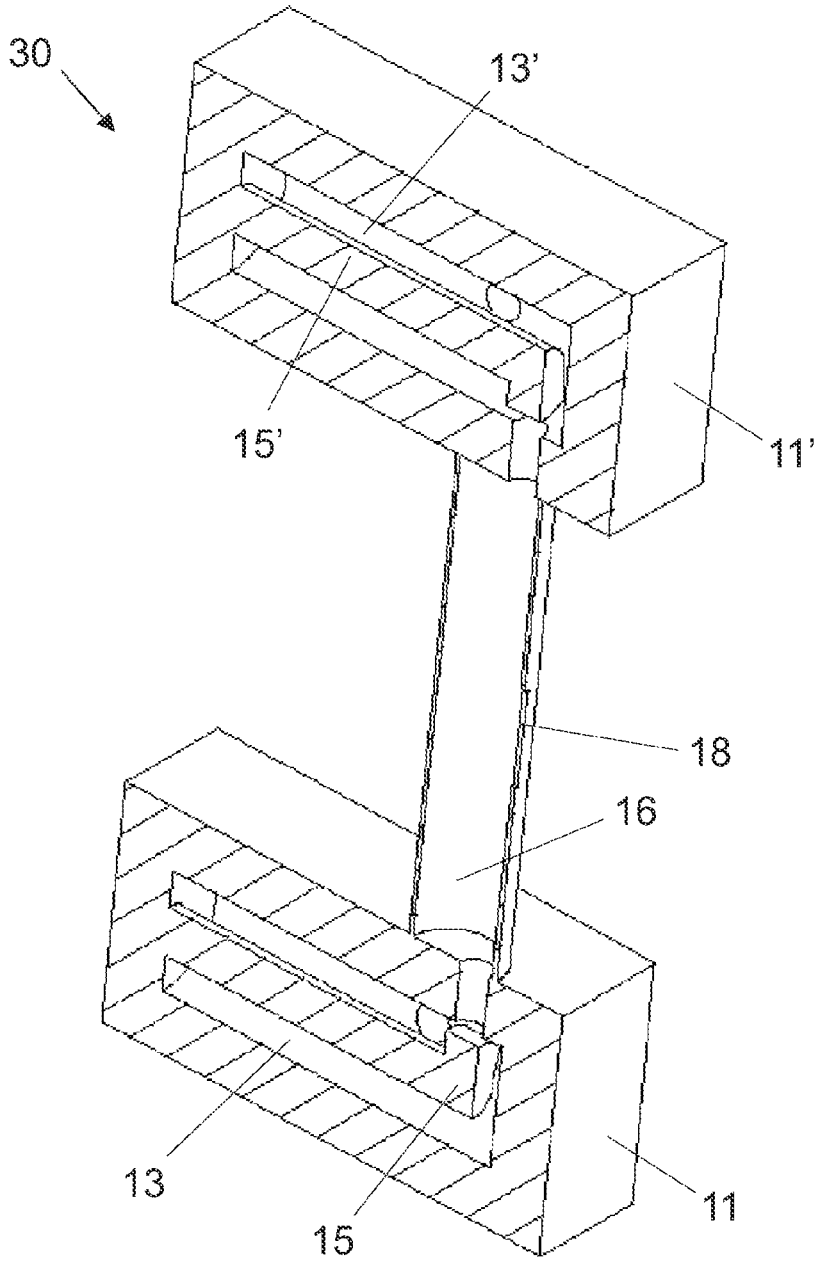

FIGS. 7 and 8 show, respectively and according to another embodiment, a front cross section and a perspective cross section of a double-cavity ion source 30, with a plane of symmetry 31 in the central portion of the ion-extraction aperture 18, both cavities (13, 13') being connected by a common expansion chamber 16, which allows the expansion of the plasma column 23 produced in each cavity (13, 13'). The elements of the ion source 30 for each of the two cavities (13, 13') are the same as those shown in FIGS. 3 to 6 for the ion source 10 having a single cavity (first body 11 and second body 11', first coaxial conductor 15 and second coaxial conductor 15', first conductive protuberance 22 and second conductive protuberance 22', first plasma outlet hole 17 and second plasma outlet hole 17', etc.), with the particularity in this case that both cavities (13, 13') are opposite each other and share the expansion chamber 16. Double-cavity ion sources 30 are used to obtain plasma more easily and increase the production of particles, such that at both ends there are two plasma jets that converge at the height of the plane of symmetry 31, forming a single plasma column 23 in the central portion, wherein the ion-extraction aperture 18 is located to remove the desired particles, whether they are positive or negative ions.

The length of the resonant cavity (along the Y-axis) is of the order of or less than $\lambda/4$ (where $\lambda$ is the wavelength associated with the oscillating electromagnetic field given by the ratio $\lambda=f/c$, where f is the oscillation frequency and c speed of light) in the case of resonant cavities short-circuited at one end (quarter-wave cavities). In the case of half-wave resonant cavities, short-circuited at both ends and with plasma formation in the central portion of the inner conductor, the length of the resonant cavity will be of the order of or less than $\lambda/2$. The transverse dimensions, as well as those of the conductive protuberance 22 for concentrating the electric field, are determined by the specific parameters of the resonant cavity to be obtained, mainly the quality factor Q and characteristic impedance R/Q, and they will also have an effect on the resonant frequency of the cavity.

The interior walls of the body 11 are made of a conductive material with low electrical resistivity and high thermal conductivity, generally copper or copper deposited on another metal, since there is a desire for the Q factor to be high and the power deposited on the walls to be rapidly dissipated.

To operate the ion source (10; 30), one starts from the initial state, where there is no energy in the cavity 13 or cavities (13, 13'). The radio frequency energy that is introduced into the cavity is produced in a generator, which can be solid state, electron tube (magnetron, TWT, gyrotron, klystron, etc.) or a coil and capacitor resonant circuit, depending on the frequency, power and required working mode. Said power travels through a waveguide, generally coaxial or hollow (e.g., rectangular), to the cavity, wherein the power is transferred to the resonant cavity through a coupling (electrical, inductive or through-hole), minimising reflections and power losses. As electromagnetic energy is introduced into the cavity (with a frequency equal to the resonant frequency of the cavity), the value of the electric field increases in magnitude in such a way that it reaches a point when the plasma ignites (Paschen curve for oscillating electromagnetic fields). Once the plasma is formed, which expands through the plasma outlet hole 17 spreading along the magnetic field lines generated by an electromagnet or a permanent magnet, the resonant frequency of the cavity shifts, such that if the frequency of the electromagnetic field supplied to the cavity remains constant, power begins to be reflected due to the difference in impedances, reaching a point when all the power except that which is necessary to maintain the discharge and compensate for losses in the walls of the cavity will be reflected, stabilising the system in the steady state.

According to a possible embodiment, a specific design of the present invention uses a λ/4 coaxial resonant cavity, approximately 3 cm long for a frequency of 2.45 GHz, with one end short-circuited and the other open, and made of copper. In the portion of the open end of the inner coaxial conductor 15 there is a conductive protuberance 22 protruding in the same direction as the magnetic field (in the vertical direction Z) which is opposite the plasma outlet hole 17 and which allows increasing the electric field in that area to achieve plasma formation with less power. The plasma leaves through the plasma outlet hole 17 and enters the expansion chamber 16, where it spreads mainly in the direction of the magnetic field lines (parallel to the Z-axis) forming a plasma column 23, and passes close to the ion-extraction aperture 18, wherein the ions are extracted by means of an electric field.

In the embodiment shown in the figures, the gas supply inlet 14 is implemented by means of a simple hole connected to a tube 20, while the coupling of the radio frequency system is carried out with electrical coupling by means of a protruding cylinder (dielectric 25) connected to the inner conductor 26 of a coaxial waveguide 24. Other alternatives for introducing power are a magnetic coupling through a loop or a hole made in a waveguide. The resonant frequency of the cavity is adjusted by the moving part 27.

Figure 9:
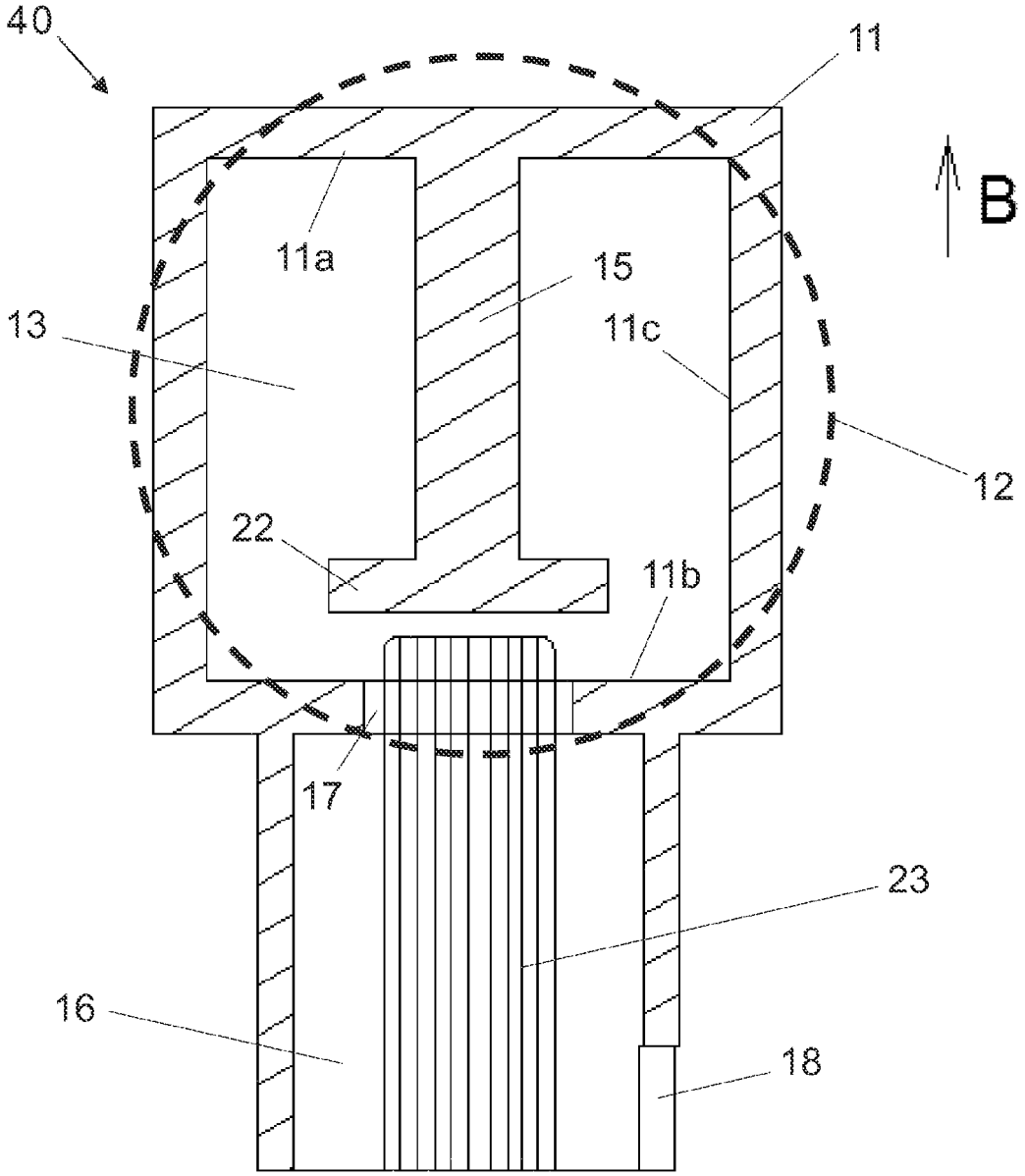
FIG. 9 represents another possible embodiment of an ion source, especially suitable for cyclotrons with an axial configuration.

FIG. 9 illustrates an ion source 40 according to another possible embodiment, wherein the location of the plasma outlet hole 17 (in this case it is located in the circular second interior wall 11*b*) and the orientation of the expansion chamber 16 changes with respect to the cavity 13. Furthermore, the conductive protuberance 22 of the ion source 40 for this embodiment preferably has a circular cross section, to thereby maintain internal symmetry in the cavity 13 (the conductive protuberance 22 of FIG. 9 protrudes on each side, top and bottom, of the coaxial conductor 15). However, the conductive protuberance 22 of FIG. 3 can have different types of cross sections, depending on the geometry and dimensions of the cavity, the coaxial conductor and the plasma outlet hole (the cross section can be optimised by means of simulation to obtain a greater concentration of the electric field opposite of the plasma outlet hole 17 that favours the formation and stability of the plasma), so that the conductive protuberance 22 only protrudes on one side, at the top. The upper circle illustrated in FIG. 9 represents the resonator 12 (i.e., the coaxial resonant cavity) that forms when ion source 40 is in operation.

While in the ion source 10 of FIGS. 3 to 6 the main axis of the expansion chamber 16 is disposed perpendicular to the axis of the cylindrical cavity 13, in the ion source 40 of FIG. 9 both axes are parallel (in the example of FIG. 9 they coincide), which allows the ion sources to be axially coupled in cyclotrons.

Figure 10:
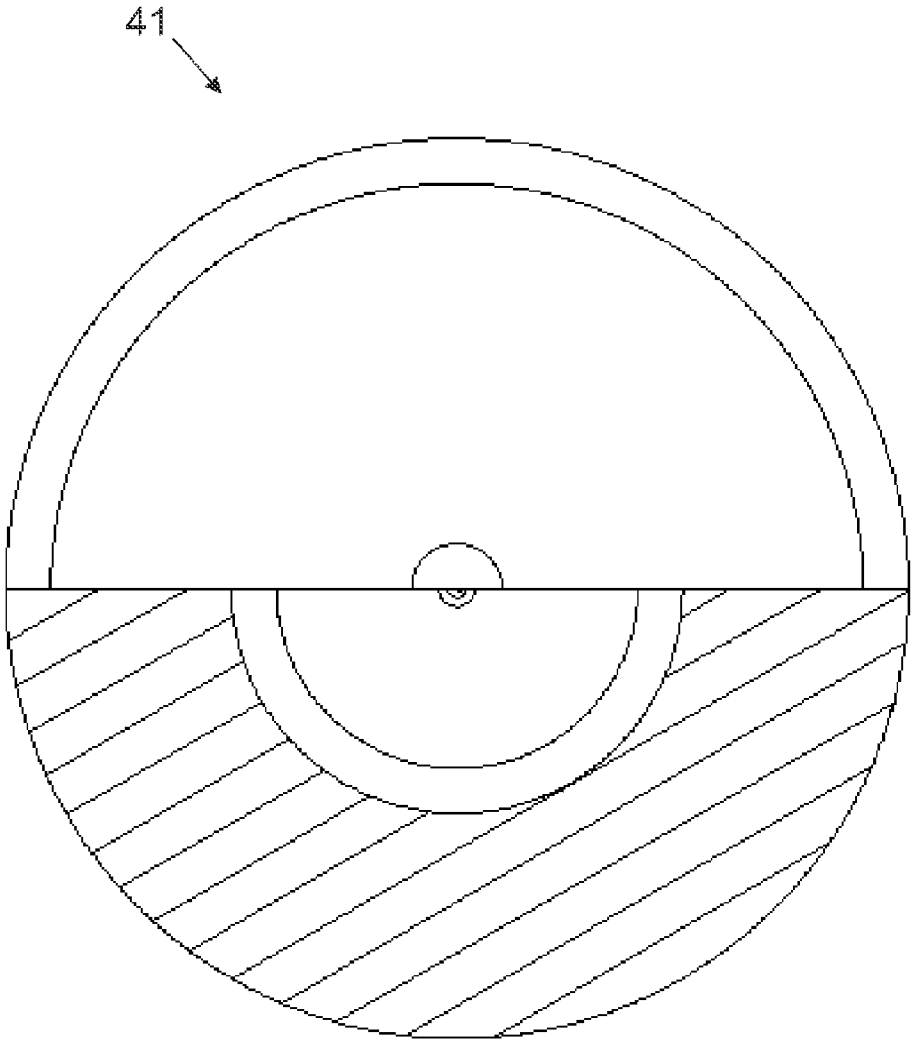
FIGS. 10 and 11 show a cyclotron with an axial configuration for introducing the ion source.
Figure 11:
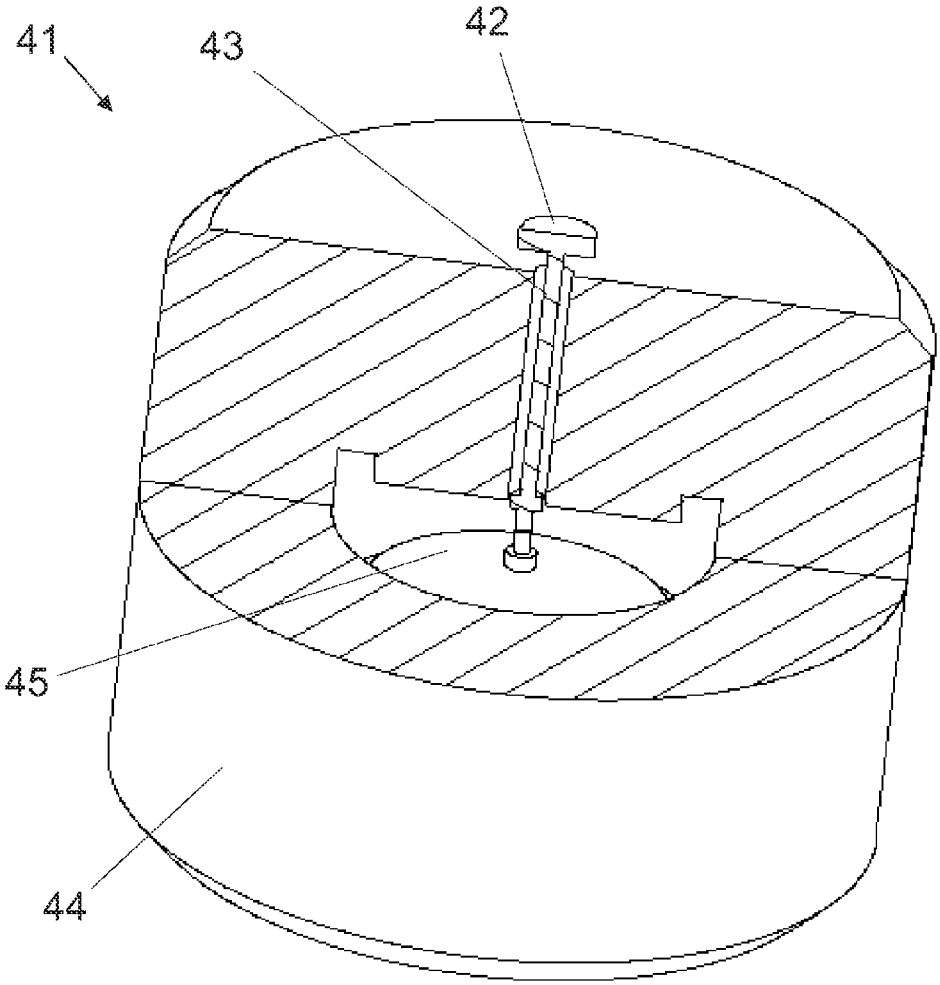
Figure 12:
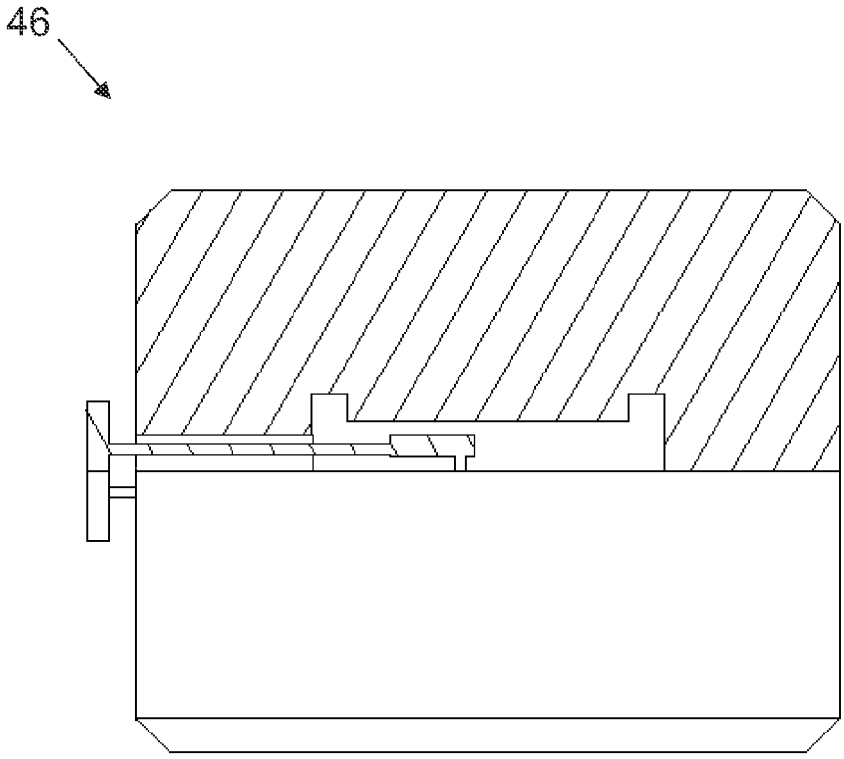
FIGS. 12 and 13 show a cyclotron with a radial configuration for introducing the ion source.
Figure 13:
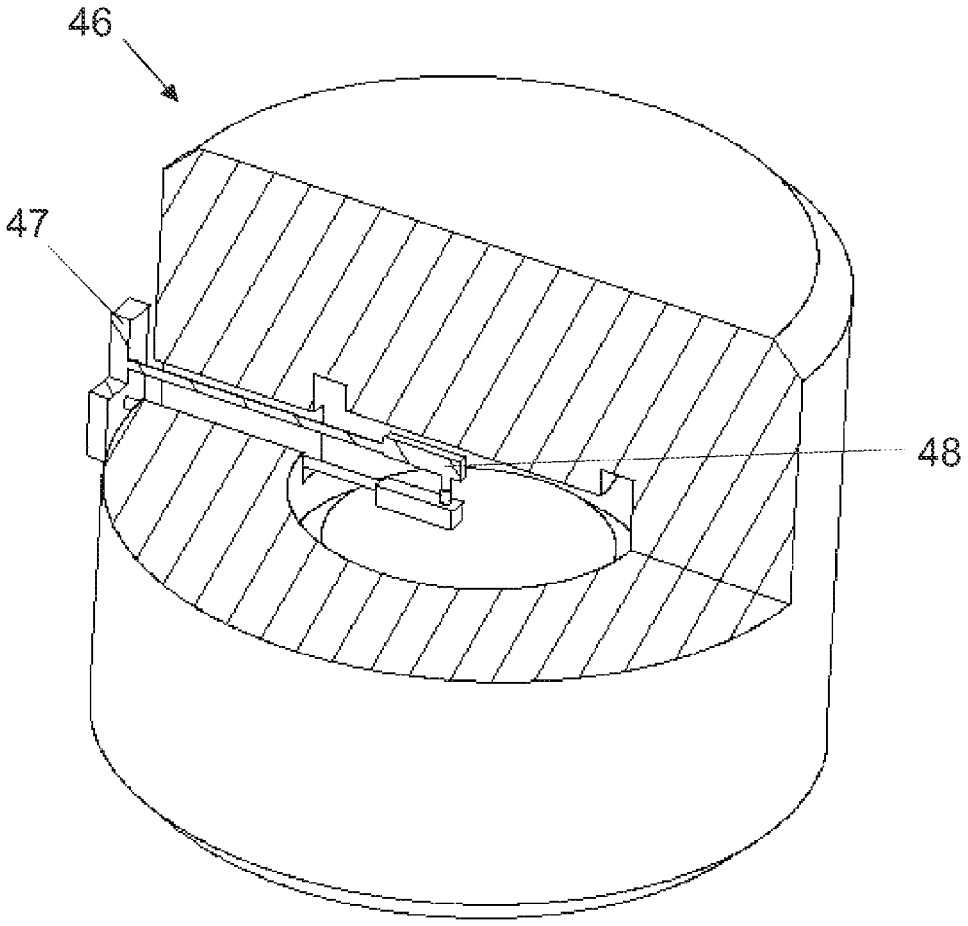

Internal ion sources for cyclotrons can be radially or axially introduced into the cyclotron. FIGS. 10 and 11 show, respectively, a front and perspective view (partially sectioned) of a cyclotron 41 (in the figure of the cyclotron, components such as the magnet coils, the radio frequency-acceleration system, the extraction system and the vacuum and opening system of the iron have been omitted) with axial configuration for introducing an ion source. In the cyclotron 41 of FIGS. 10 and 11, the ion source is introduced with the axial configuration of FIG. 9, wherein the electromagnetic and mechanical design of the ion sources is simpler. FIGS. 12 and 13 show a cyclotron 46 with radial configuration for introducing the ion source, wherein the design of the ion sources is more complicated (it corresponds to the ion sources represented in FIGS. 3 to 6). In FIGS. 10, 11, 12 and 13, the following references are used:

- 41 and 46—Cyclotron.
- 42 and 47—Ion source flange. It has gas bushings, the waveguide and liquid cooling (if necessary). It also creates the vacuum seal.
- 43—Gas tube, waveguide and cooling. They act as a mechanical support for the ion source and can be integrated or stand alone. It could include a dedicated stand if necessary. In the case of radial insertion, they are usually shielded to withstand the impact of the particles that are lost.
- 44—Magnet iron. It guides the magnetic field and is used to attenuate radiation.
- 45—Magnet pole (the circular portion can be machined to modify the magnetic field).
- 48—Ion source.

Figure 14:
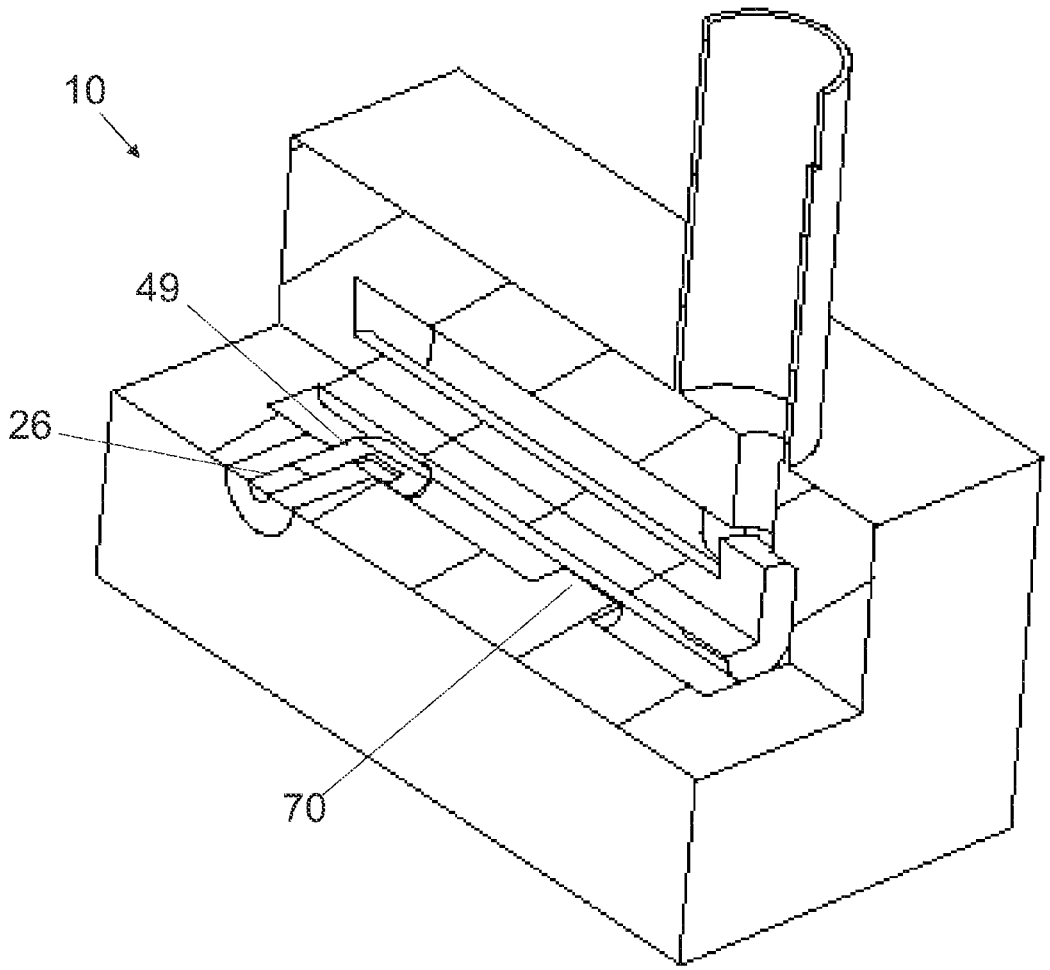
FIG. 14 shows an embodiment of the ion source similar to that shown in FIG. 6 but replacing the capacitive coupling with an inductive coupling.
Figure 15:
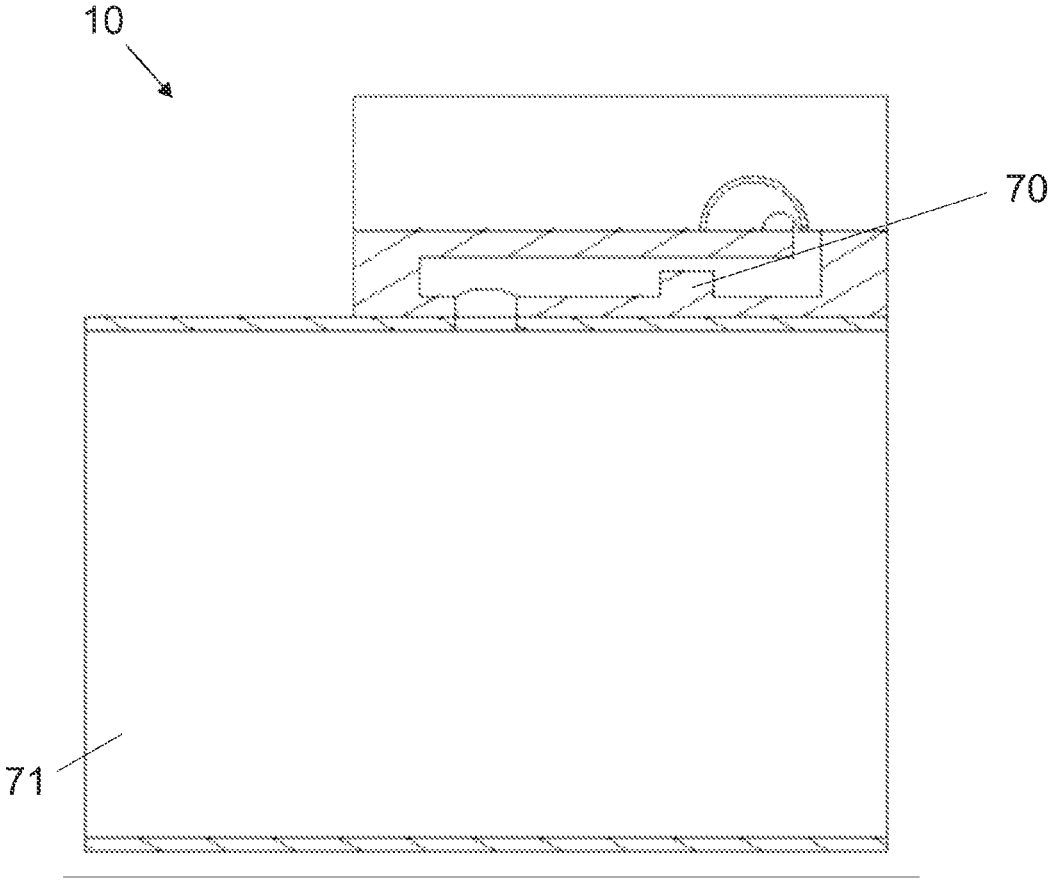
FIGS. 15 and 16 show an embodiment of the ion source with a different type of coupling (rectangular waveguide coupling).
Figure 16:
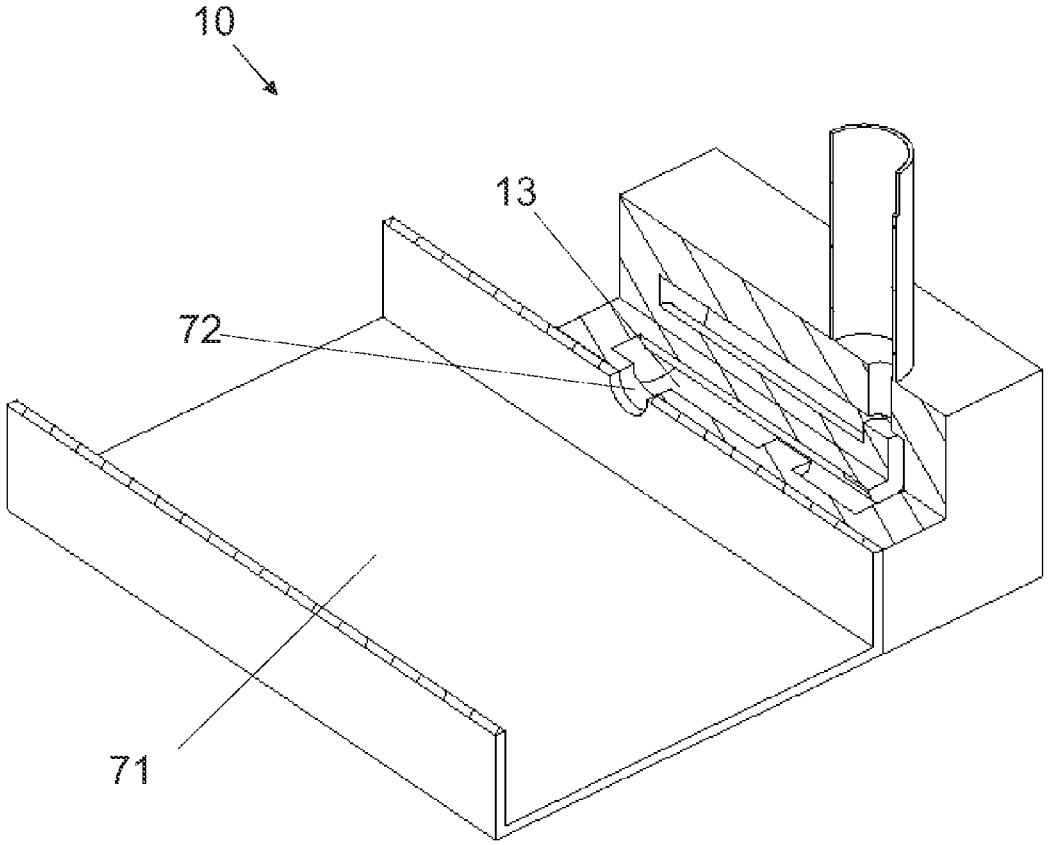
Figure 17:
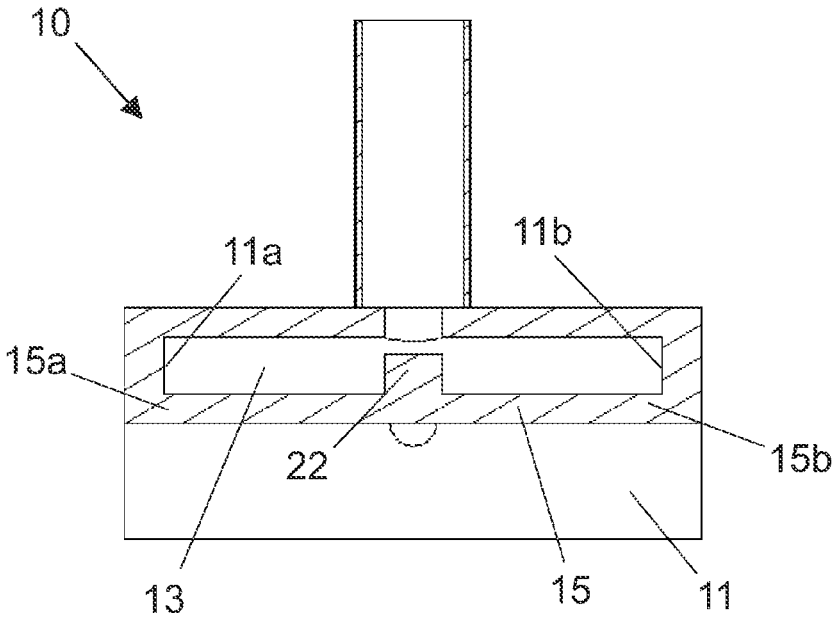
FIGS. 17, 18, 19 and 20 show different partial cross-sectional views of an ion source according to another possible embodiment.
Figure 18:
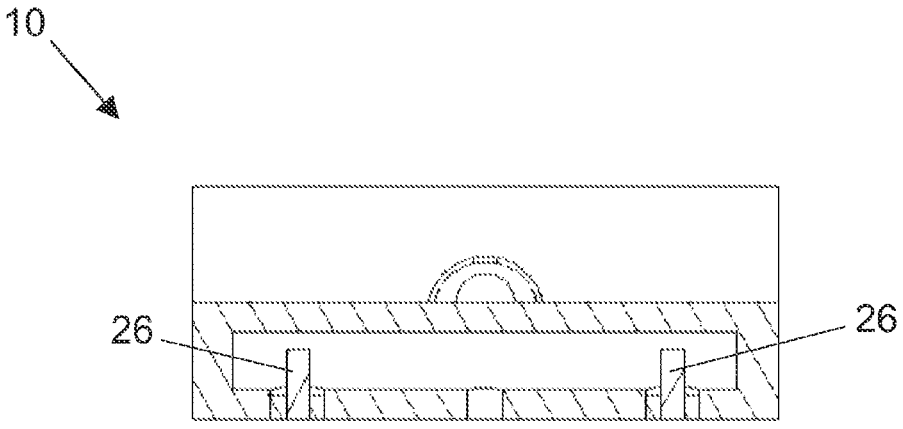
Figure 19:
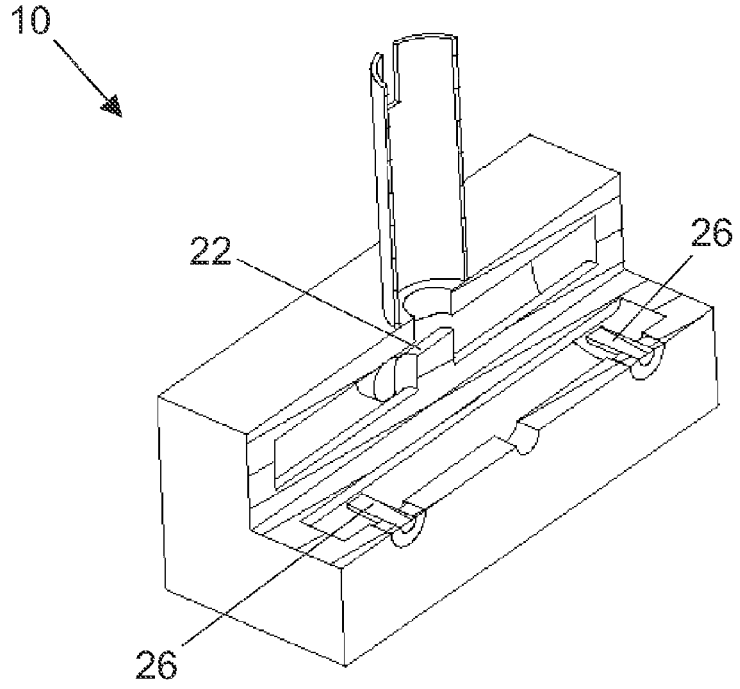
Figure 20:
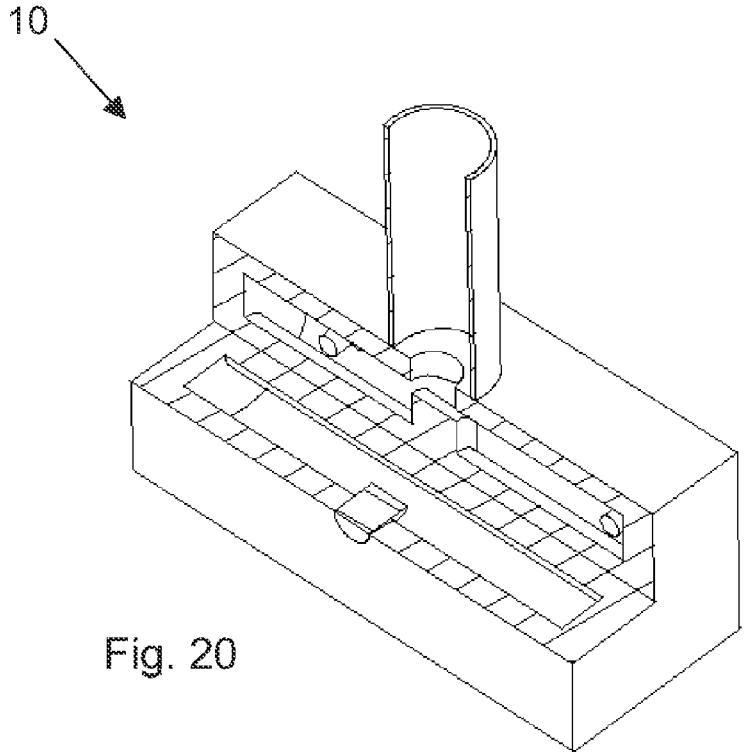

As indicated above in the description of FIG. 4, a coaxial waveguide 24 which transports radio frequency/microwave energy is coupled through the power supply input 21. The coupling can be electrical/capacitive or magnetic/inductive. FIG. 14 shows an embodiment like the one shown in FIG. 6 but replacing the capacitive coupling with a magnetic coupling, wherein a loop 49 short-circuits the inner conductor 26 of the coaxial waveguide 24 with the interior wall of the body 11. FIGS. 15 and 16 show another type of coupling, coupling by rectangular waveguide 71, in two different views (top view and perspective view, with a partial cross section). In this case, the coupling is performed by means of a hole 72 that joins the cavity 13 to the vacuum of the rectangular waveguide 71. It would act as an electric dipole and a magnetic dipole that radiate on both sides, such that if there is higher energy density on one side, energy is transferred to the other side until they reach equilibrium. In this embodiment, the ion source 10 has larger dimensions due to the rectangular waveguide 71, which must also be under vacuum.

FIGS. 17, 18, 19 and 20 show different views in partial section (in particular, a front view, a top view, a front perspective view and a rear perspective view, respectively) of an embodiment of the ion source 10 wherein the two ends (15*a*, 15*b*) of the coaxial conductor 15 are respectively in contact with the two circular interior walls (11*a*, 11*b*) of the body 11, thus obtaining a λ/2 coaxial resonant chamber.

Figure 21:
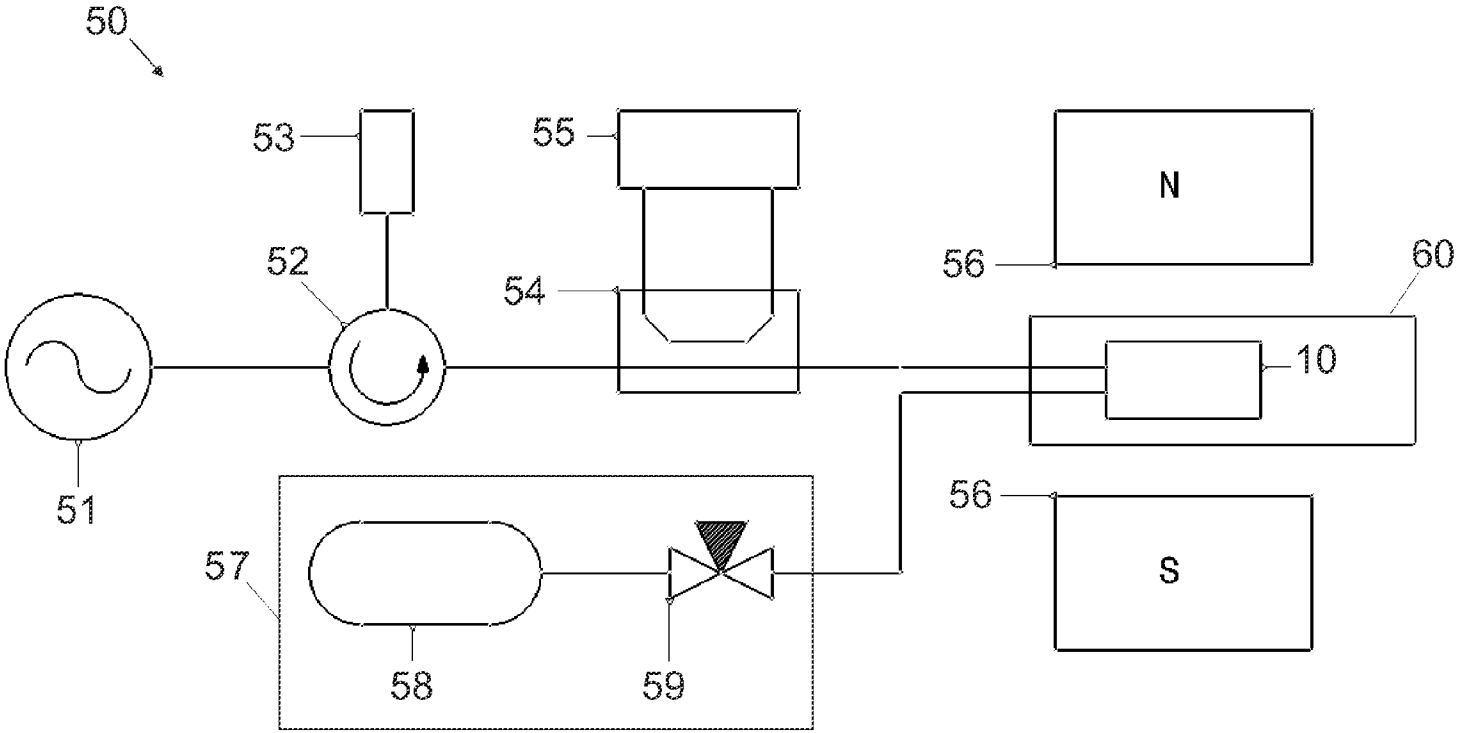
FIG. 21 illustrates, by way of example, a complete radio frequency system in which the ion source of the present invention can be used.

FIG. 21 shows, by way of example, a complete radio frequency system 50 in which the ion source (10; 30; 40) of the present invention can be used. The radio frequency system comprises a generator 51 of sufficient power and adjustable parameters to achieve the ignition of the plasma, a circulator 52 with a load 53 to absorb the reflected power and a directional coupler 54 with a power meter 55 to monitor the incident and reflected power.

The ion source (10; 30; 40) is placed immersed in a magnetic field generated by an electromagnet or by a permanent magnet 56, wherein the direction of the field lines is not important, only their movement. The ion source (10; 30; 40) is joined through the gas supply inlet 14 to a gas injection system 57, which comprises a gas reservoir or tank 58 and is dosed by means of a regulation system 59. The ion source (10; 30; 40) is disposed in a chamber 60 with sufficient vacuum so that the ions are not neutralised by the residual gas and can be accelerated for later use.

The necessary radio frequency power is provided by the generator 51, and the transmitted power is measured with the power meter 55 connected to the directional coupler 54. The generator 51 is protected with the circulator 52 which diverts the power reflected by the ion source (10; 30; 40) to the load 53.

The invention claimed is:

1. A low-erosion internal ion source for cyclotrons, comprising:

a hollow body having circular interior walls defining a cylindrical cavity, wherein the body has a gas supply inlet through which a plasma-forming gas is introduced into the cavity;

a coaxial conductor disposed in the cavity of the body and arranged parallel to a longitudinal axis of the cavity;

an expansion chamber connected to the cavity through a plasma outlet hole made in the body;

an ion-extraction aperture in contact with the expansion chamber;

wherein:

the body has a power supply input through which radio frequency energy is injected into the cavity;

the interior walls of the body are conductive;

the coaxial conductor having ends, at least one of the ends of the coaxial conductor is in contact with at least one of the circular interior walls of the body, forming a coaxial resonant cavity;

the coaxial conductor has a conductive protuberance that extends radially into the cavity, said conductive protuberance being opposite the plasma outlet hole.

2. The low-erosion internal ion source for cyclotrons according to claim 1, further comprising a movable part partially introduced radially into the cavity through an opening made in the body to finely adjust the frequency of the resonant cavity.

3. The low-erosion internal ion source for cyclotrons according to claim 2, wherein the movable part is made of conductive material.

4. The low-erosion internal ion source for cyclotrons according to claim 2, wherein the movable part is made of dielectric material.

5. The low-erosion internal ion source for cyclotrons according to claim 1, wherein the radio frequency energy supply is provided through a capacitive coupling by means of a coaxial waveguide whose inner conductor is partially introduced into the cavity through the power supply input.

6. The low-erosion internal ion source for cyclotrons according to claim 1, wherein the radio frequency energy supply is provided through an inductive coupling by means of a loop that short-circuits an interior wall of the body with an inner conductor of a coaxial waveguide introduced through the power supply input.

7. The low-erosion internal ion source for cyclotrons according to claim 1, wherein a first end of the coaxial conductor is in contact with a circular interior wall of the body, a second end of the coaxial conductor being free, and wherein the conductive protuberance is disposed at the second end of the coaxial conductor.

8. The low-erosion internal ion source for cyclotrons according to claim 7, wherein the expansion chamber is cylindrical, and the longitudinal axis of the cavity is arranged perpendicular to the longitudinal axis of the expansion chamber.

9. The low-erosion internal ion source for cyclotrons according to claim 7, wherein the expansion chamber is cylindrical, and the longitudinal axis of the cavity is arranged parallel to a longitudinal axis of the expansion chamber.

10. The low-erosion internal ion source for cyclotrons according to claim 1, wherein the first and second ends of the coaxial conductor are respectively in contact with two circular interior walls of the body.

11. The low-erosion internal ion source for cyclotrons according to claim 10, wherein the conductive protuberance is disposed in a central portion of the coaxial conductor.

12. The low-erosion internal ion source for cyclotrons according to claim 1, wherein the body is conductive.

13. The low-erosion internal ion source for cyclotrons according to claim 1 further comprising a second body and a second conductor that form a second coaxial resonant cavity; the cavities of the bodies being connected to each other through a common expansion chamber.

* * * * *